US011939743B2

(12) United States Patent
Harada

(10) Patent No.: US 11,939,743 B2
(45) Date of Patent: Mar. 26, 2024

(54) CONTROL SYSTEM AND CONTROL METHOD FOR WORK MACHINE

(71) Applicant: KOMATSU LTD., Tokyo (JP)

(72) Inventor: Junji Harada, Tokyo (JP)

(73) Assignee: KOMATSU LTD., Tokyo (JP)

( * ) Notice: Subject to any disclaimer, the term of this patent is extended or adjusted under 35 U.S.C. 154(b) by 413 days.

(21) Appl. No.: 17/419,881

(22) PCT Filed: Feb. 17, 2020

(86) PCT No.: PCT/JP2020/006038
§ 371 (c)(1),
(2) Date: Jun. 30, 2021

(87) PCT Pub. No.: WO2020/171014
PCT Pub. Date: Aug. 27, 2020

(65) Prior Publication Data

US 2022/0049457 A1 Feb. 17, 2022

(30) Foreign Application Priority Data

Feb. 19, 2019 (JP) ..... 2019-027644

(51) Int. Cl.
*E02F 3/84* (2006.01)
*E02F 3/76* (2006.01)
(Continued)

(52) U.S. Cl.
CPC ..... *E02F 3/844* (2013.01); *E02F 9/262* (2013.01); *E02F 9/265* (2013.01); *E02F 3/7618* (2013.01); *E02F 9/2225* (2013.01)

(58) Field of Classification Search
CPC ..... E02F 3/7618; E02F 3/844; E02F 9/2225; E02F 9/262; E02F 9/265
See application file for complete search history.

(56) References Cited

U.S. PATENT DOCUMENTS 4,174,761 A 11/1979 Matsuyoshi et al.
6,718,246 B2 * 4/2004 Griffith ..... E02F 3/84 701/50

(Continued)

FOREIGN PATENT DOCUMENTS

CN 103732431 A 4/2014
CN 108779618 A 11/2018

(Continued)

OTHER PUBLICATIONS

The Office Action for the corresponding Chinese application No. 202080015243.6, dated May 20, 2022.

(Continued)

*Primary Examiner* — Tyler J Lee
(74) *Attorney, Agent, or Firm* — Global IP Counselors, LLP

(57) ABSTRACT

A work machine includes a work implement. A control system for the work machine includes a controller configured to operate the work implement according to a target trajectory for a backward movement while the work machine is moving backward. A method is performed by a processor for controlling a work machine including a work implement. The method includes operating the work implement according to a target trajectory for a backward movement while the work machine is moving backward.

18 Claims, 17 Drawing Sheets

(51) Int. Cl.
*E02F 9/22* (2006.01)
*E02F 9/26* (2006.01)

(56) References Cited

U.S. PATENT DOCUMENTS

| | | | | |
|---|---|---|---|---|
| 7,058,495 | B2 * | 6/2006 | Budde | E02F 3/845 37/234 |
| 7,448,453 | B2 * | 11/2008 | Tobin | E02F 3/7631 172/828 |
| 9,222,236 | B2 * | 12/2015 | Ishibashi | E02F 9/2041 |
| 2003/0204297 | A1 * | 10/2003 | Griffith | E02F 3/84 701/50 |
| 2011/0178684 | A1 * | 7/2011 | Umemoto | F16H 61/431 477/115 |
| 2013/0325208 | A1 | 12/2013 | Osagawa et al. | |
| 2014/0163804 | A1 | 6/2014 | Kaneko et al. | |
| 2018/0038082 | A1 | 2/2018 | Hashimoto et al. | |
| 2018/0373032 | A1 * | 12/2018 | Ohiwa | E02F 9/265 |
| 2019/0078301 | A1 | 3/2019 | Ishibashi et al. | |
| 2019/0093315 | A1 | 3/2019 | Ishibashi et al. | |
| 2019/0368160 | A1 * | 12/2019 | Green | E02F 9/2037 |
| 2020/0123738 | A1 * | 4/2020 | Espinosa | E02F 9/221 |

FOREIGN PATENT DOCUMENTS

| | | | |
|---|---|---|---|
| CN | 108884658 | A | 11/2018 |
| FR | 2 405 834 | A1 | 5/1979 |
| JP | 9-209393 | A | 8/1997 |
| JP | 3657050 | B2 | 6/2005 |
| JP | 2012-232608 | A | 11/2012 |
| JP | 5140864 | B2 | 2/2013 |
| JP | 5859093 | B1 | 2/2016 |
| JP | 2016-85705 | A | 5/2016 |
| JP | 2018-21348 | A | 2/2018 |

OTHER PUBLICATIONS

The Office Action for the corresponding Japanese application No. 2019-027644, dated Feb. 14, 2023.
The International Search Report for the corresponding international application No. PCT/JP2020/006038, dated Apr. 28, 2020.

* cited by examiner

CONTROL SYSTEM AND CONTROL METHOD FOR WORK MACHINE

This application is a U.S. National stage application of International Application No. PCT/JP2020/006038, filed on Feb. 17, 2020. This U.S. National stage application claims priority under 35 U.S.C. § 119(a) to Japanese Patent Application No. 2019-027644, filed in Japan on Feb. 19, 2019, the entire contents of which are hereby incorporated herein by reference.

BACKGROUND

Field of the Invention

The present disclosure relates to a control system and a control method for a work machine.

Background Information

Conventionally, in a work machine such as a bulldozer, a control for automatically adjusting a position of the work implement has been proposed. For example, in Japanese Laid-open Patent Application Publication No. 2018-021348, the controller determines a target design surface. At least part of the target design surface is located below the current terrain. While the work machine is moving forward, the controller moves the work implement up and down according to the target design surface. As a result, the current terrain is excavated.

SUMMARY

The work machine may not only move forward, but also move backward. However, the above technique does not describe the control of the work machine when moving backward.

An object of the present disclosure is to improve an efficiency of work by a work machine.

A first aspect is a control system for a work machine including a work implement, comprising a controller. While the work machine is moving backward, the controller operates the work implement according to a target trajectory for a backward movement.

A second aspect is a method performed by a processor for controlling a work machine including a work implement. The method includes operating the work implement according to a target trajectory for a backward movement while the work machine is moving backward.

Advantageous Effects of Invention

According to the present disclosure, when the work machine is moving backward, the work implement operates according to the target trajectory. As a result, the efficiency of work by the work machine can be improved.

DETAILED DESCRIPTION OF EMBODIMENT(S)

Figure 1:
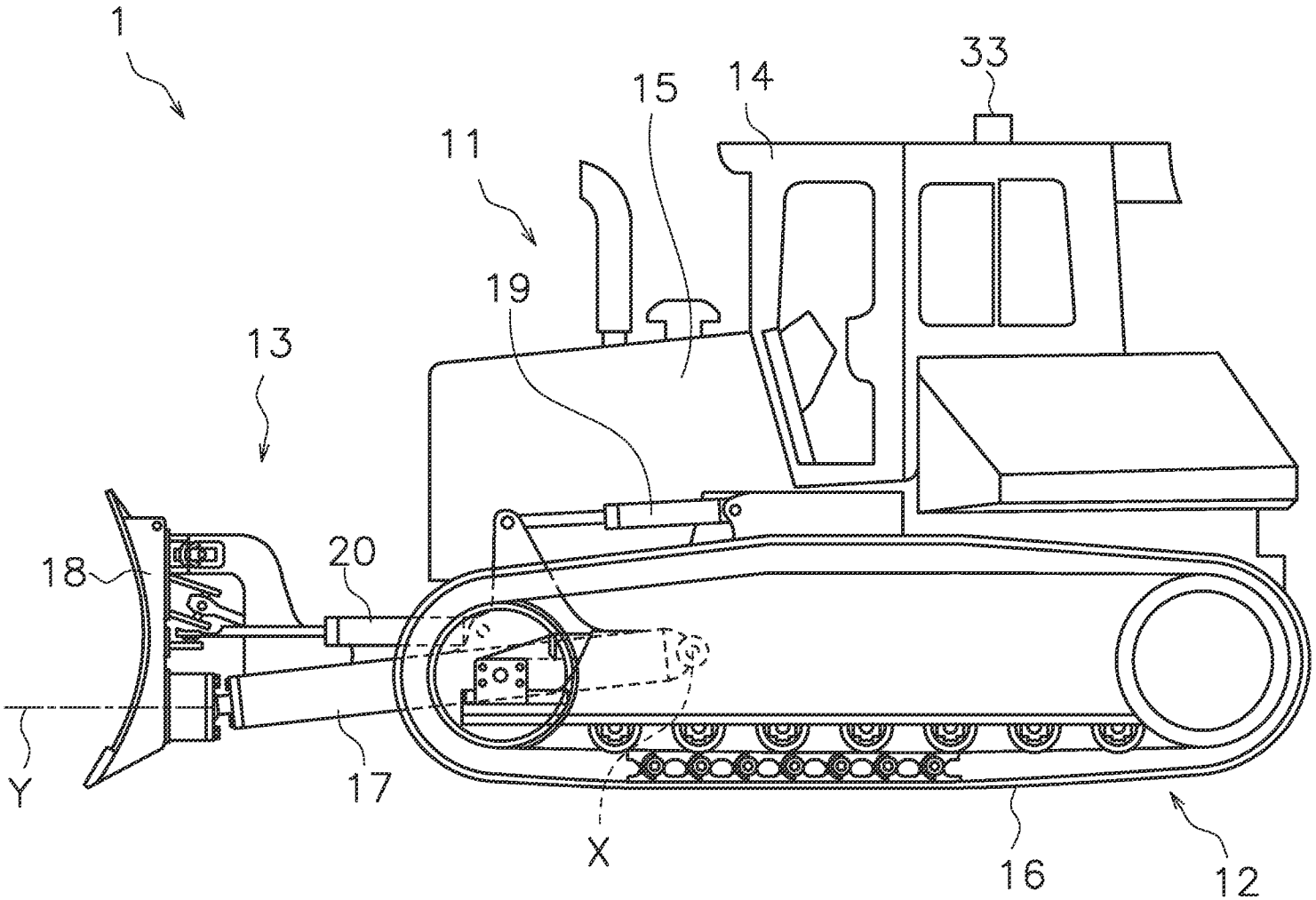
FIG. 1 is a side view showing a work machine according to an embodiment.

Hereinafter, a work machine according to an embodiment will be described with reference to the drawings. FIG. 1 is a side view showing the work machine 1 according to the embodiment. The work machine 1 according to the present embodiment is a bulldozer. The work machine 1 includes a vehicle body 11, a traveling device 12, and a work implement 13.

The vehicle body 11 includes a cab 14 and an engine compartment 15. A driver's seat (not illustrated) is arranged in the cab 14. The engine compartment 15 is arranged in front of the cab 14. The traveling device 12 is attached to the lower part of the vehicle body 11. The traveling device 12 has left and right crawler tracks 16. In FIG. 1, only the left crawler track 16 is illustrated. The work machine 1 travels by rotating the crawler tracks 16.

The work implement 13 is attached to the vehicle body 11. The work implement 13 includes a lift frame 17, a blade 18, a lift cylinder 19, and a tilt cylinder 20.

The lift frame 17 is attached to the vehicle body 11 so as to be movable up and down about the axis X. The axis X extends in a vehicle width direction. The lift frame 17 supports the blade 18. The blade 18 is arranged in front of the vehicle body 11. The blade 18 moves up and down with the operation of the lift frame 17. The lift frame 17 may be attached to the traveling device 12.

The lift cylinder 19 is connected to the vehicle body 11 and the lift frame 17. As the lift cylinder 19 expands and contracts, the lift frame 17 moves up and down about the axis X. The tilt cylinder 20 is connected to the vehicle body 11 and the blade 18. As the tilt cylinder 20 expands and contracts, the blade 18 tilts about the axis Y. The axis Y extends in a longitudinal direction.

Figure 2:
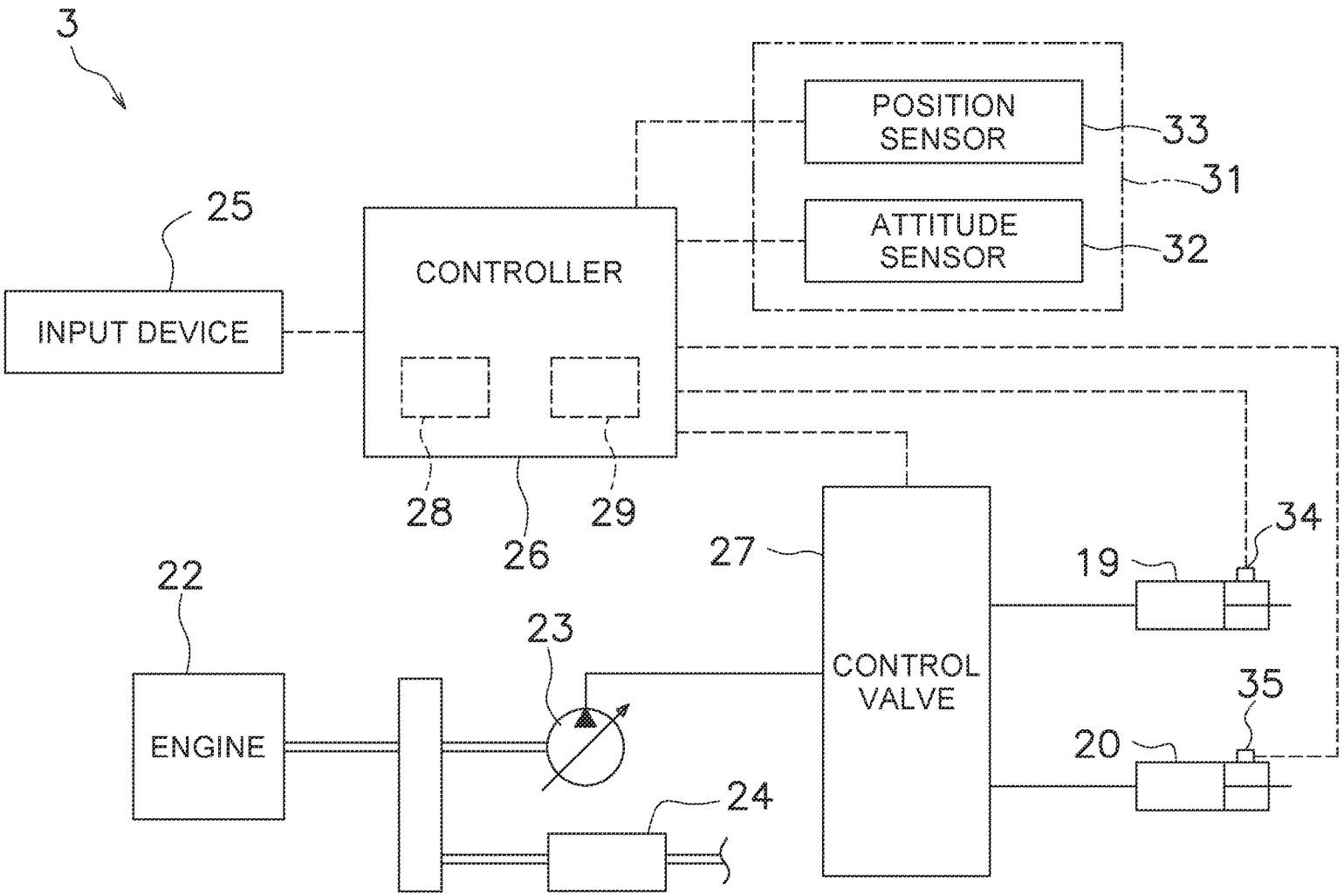
FIG. 2 is a block diagram showing a structure of a control system of the work machine.

FIG. 2 is a block diagram showing a configuration of a control system 3 of the work machine 1. In this embodiment, the control system 3 is mounted on the work machine 1. As illustrated in FIG. 2, the work machine 1 includes an engine 22, a hydraulic pump 23, and a power transmission device 24.

The hydraulic pump 23 is driven by the engine 22 and discharges hydraulic fluid. The hydraulic fluid discharged from the hydraulic pump 23 is supplied to the lift cylinder 19 and the tilt cylinder 20. Although one hydraulic pump 23 is illustrated in FIG. 2, a plurality of hydraulic pumps may be provided.

The power transmission device 24 transmits the driving force of the engine 22 to the traveling device 12. The power transmission device 24 may be, for example, an HST (Hydro Static Transmission). Alternatively, the power transmission device 24 may be, for example, a torque converter or a transmission having a plurality of speed gears.

The control system 3 includes an input device 25, a controller 26, and a control valve 27. The input device 25 is arranged in the cab 14. The input device 25 accepts an operation by the operator and outputs an operation signal according to the operation. The input device 25 outputs the operation signal to the controller 26.

The input device 25 includes an operation member such as an operation lever, a pedal, or a switch for operating the traveling device 12 and the work implement 13. The input device 25 may include a touch screen. The travel of the work machine 1 such as forward movement and backward movement is controlled according to the operation of the input device 25. The movements such as ascending and descending of the work implement 13 are controlled according to the operation of the input device 25. The tilt angle of the work implement 13 is controlled according to the operation of the input device 25.

The controller 26 is programmed to control the work machine 1 based on the acquired data. The controller 26 includes a storage device 28 and a processor 29. The storage device 28 includes a non-volatile memory such as ROM and a volatile memory such as RAM. The storage device 28 may include an auxiliary storage device such as a hard disk or an SSD (Solid State Drive). The storage device 28 is an example of a non-transitory recording medium that can be read by a computer. The storage device 28 stores computer commands and data for controlling the work machine 1.

The processor 29 is, for example, a CPU (central processing unit). The processor 29 executes a process for controlling the work machine 1 according to the program. The controller 26 runs the work machine 1 by controlling the traveling device 12 or the power transmission device 24. The controller 26 moves the blade 18 up and down by controlling the control valve 27. The controller 26 controls the control valve 27 to tilt the blade 18.

The control valve 27 is a proportional control valve and is controlled by a command signal from the controller 26. The control valve 27 is arranged between the hydraulic pump 23 and the hydraulic actuators such as the lift cylinder 19 and the tilt cylinder 20. The control valve 27 controls the flow rate of the hydraulic fluid supplied from the hydraulic pump 23 to the lift cylinder 19 and the tilt cylinder 20. The controller 26 generates a command signal to the control valve 27 so that the blade 18 operates. As a result, the lift cylinder 19 and the tilt cylinder 20 are controlled. The control valve 27 may be a pressure proportional control valve. Alternatively, the control valve 27 may be an electromagnetic proportional control valve.

Figure 3:
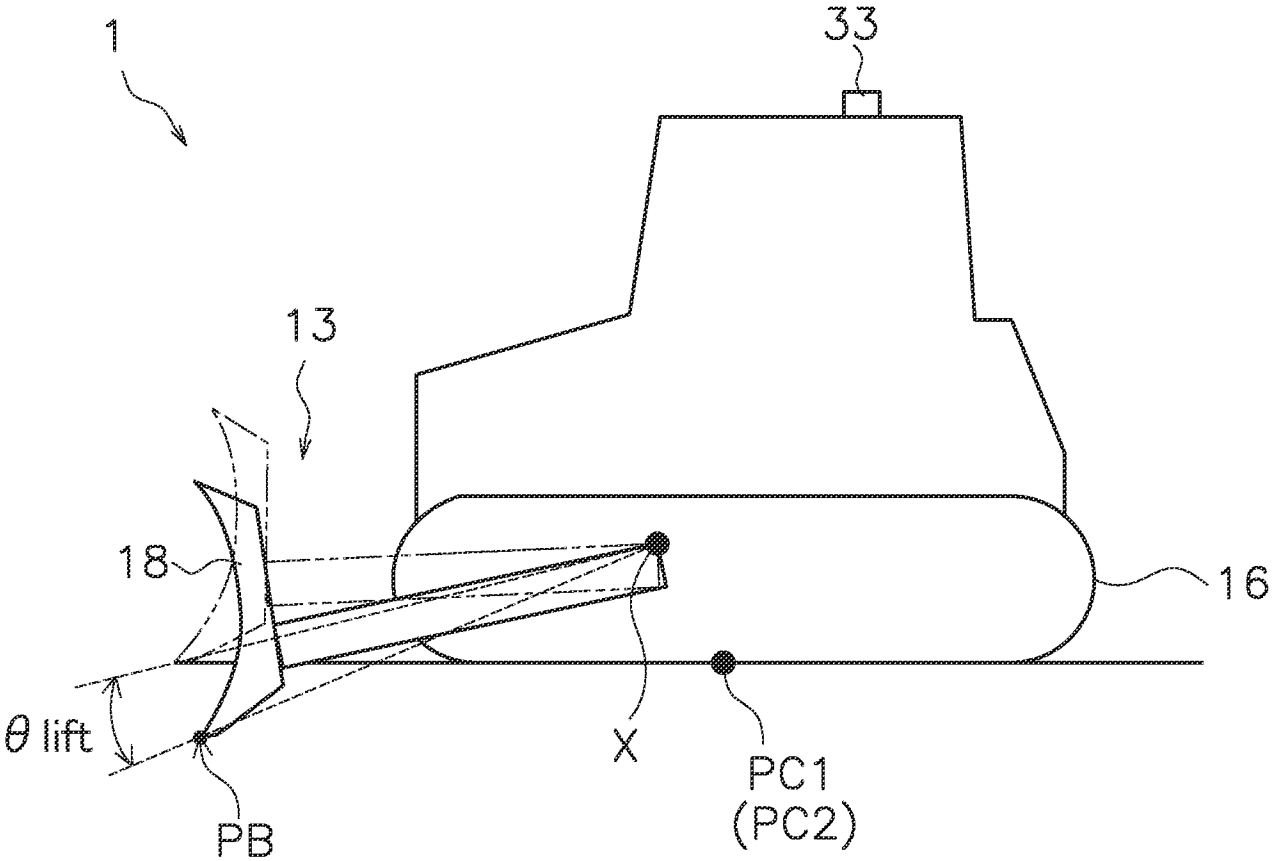
FIG. 3 is a side view showing the work machine schematically.

The control system 3 includes work implement sensors 34 and 35. The work implement sensors 34 and 35 acquire work implement position data. The work implement position data indicates a position of the work implement 13 with respect to the vehicle body 11. Specifically, the work implement sensors 34 and 35 include a lift sensor 34 and a tilt sensor 35. The work implement position data includes a lift angle θlift and a tilt angle θtilt. As illustrated in FIG. 3, the lift sensor 34 detects the lift angle θlift of the blade 18. For example, the lift sensor 34 detects a stroke length of the lift cylinder 19. The controller 26 calculates the lift angle θlift of the blade 18 from the stroke length of the lift cylinder 19. Alternatively, the lift sensor 34 may be a sensor that directly detects a rotation angle of the blade 18 around the axis X.

Figure 4:
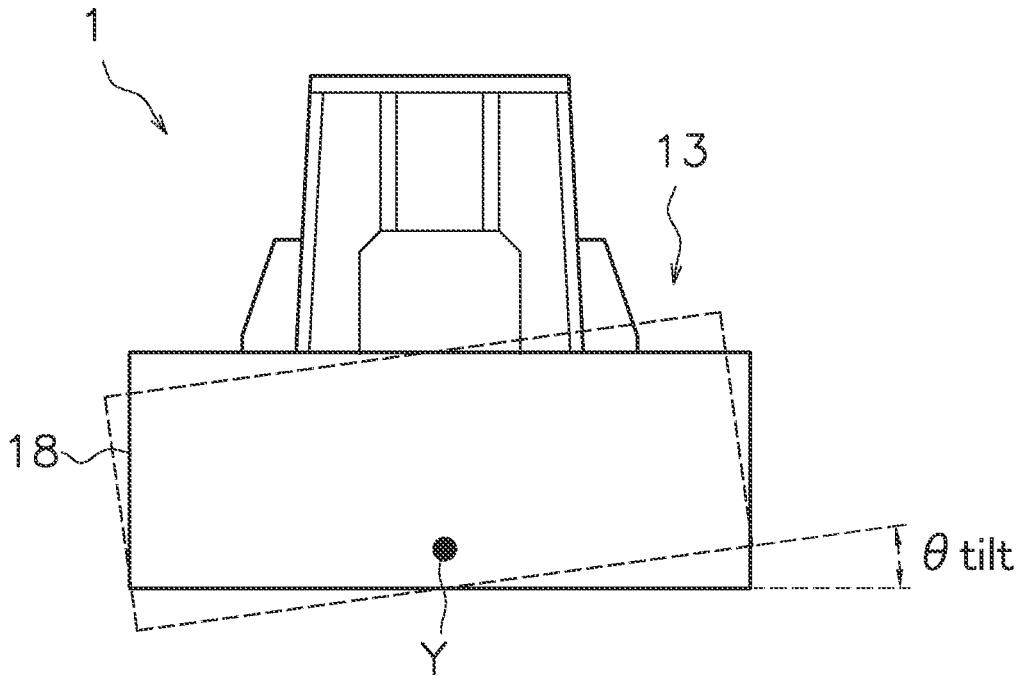
FIG. 4 is a front view showing the work machine schematically.

As illustrated in FIG. 4, the tilt sensor 35 detects the tilt angle θtilt of the blade 18. For example, the lift sensor 34 detects a stroke length of the tilt cylinder 20. The controller 26 calculates the tilt angle θtilt of the blade 18 from the stroke length of the tilt cylinder 20. Alternatively, the tilt sensor 35 may be a sensor that directly detects a rotation angle of the blade 18 around the axis Y.

As illustrated in FIG. 2, the control system 3 includes an attitude sensor 32 and a position sensor 33. The attitude sensor 32 outputs attitude data indicating a posture of the vehicle body 11. The attitude sensor 32 includes, for example, an IMU (Inertial Measurement Unit). The attitude data includes a pitch angle and a roll angle. The pitch angle is an angle with respect to the horizontal in the longitudinal direction of the vehicle body 11. The roll angle is an angle with respect to the horizontal in the vehicle width direction of the vehicle body 11. The attitude sensor 32 outputs the attitude data to the controller 26.

The position sensor 33 includes a GNSS (Global Navigation Satellite System) receiver such as GPS (Global Positioning System). The position sensor 33 receives a positioning signal from the satellite and acquires vehicle body position data from the positioning signal. The vehicle body position data shows the global coordinates of the vehicle body 11. The global coordinates indicate a position in a geographic coordinate system. The position sensor 33 outputs vehicle body position data to the controller 26. The controller 26 acquires the traveling direction and the vehicle speed of the work machine 1 from the vehicle body position data.

The controller 26 calculates the cutting edge position PB of the work implement 13 from the work implement position data, the vehicle body position data, and the attitude data. Specifically, the controller 26 calculates the global coordinates of the vehicle body 11 based on the vehicle body position data. The controller 26 calculates the local coordinates of the cutting edge position PB with respect to the vehicle body 11 based on the work implement position data and the machine data. The local coordinates indicate the position in the coordinate system with respect to the vehicle body 11. The machine data is stored in the storage device 28. The machine data includes the positions and dimensions of a plurality of components included in the work machine 1. That is, the machine data indicates the position of the work implement 13 with respect to the vehicle body 11.

The controller 26 calculates the global coordinates of the cutting edge position PB based on the global coordinates of the vehicle body 11, the local coordinates of the cutting edge position PB, and the attitude data. The controller 26 acquires the global coordinates of the cutting edge position PB as the cutting edge position data. The position sensor 33 may be attached to the blade 18. In that case, the cutting edge position PB may be directly acquired by the position sensor 33.

Figure 5:
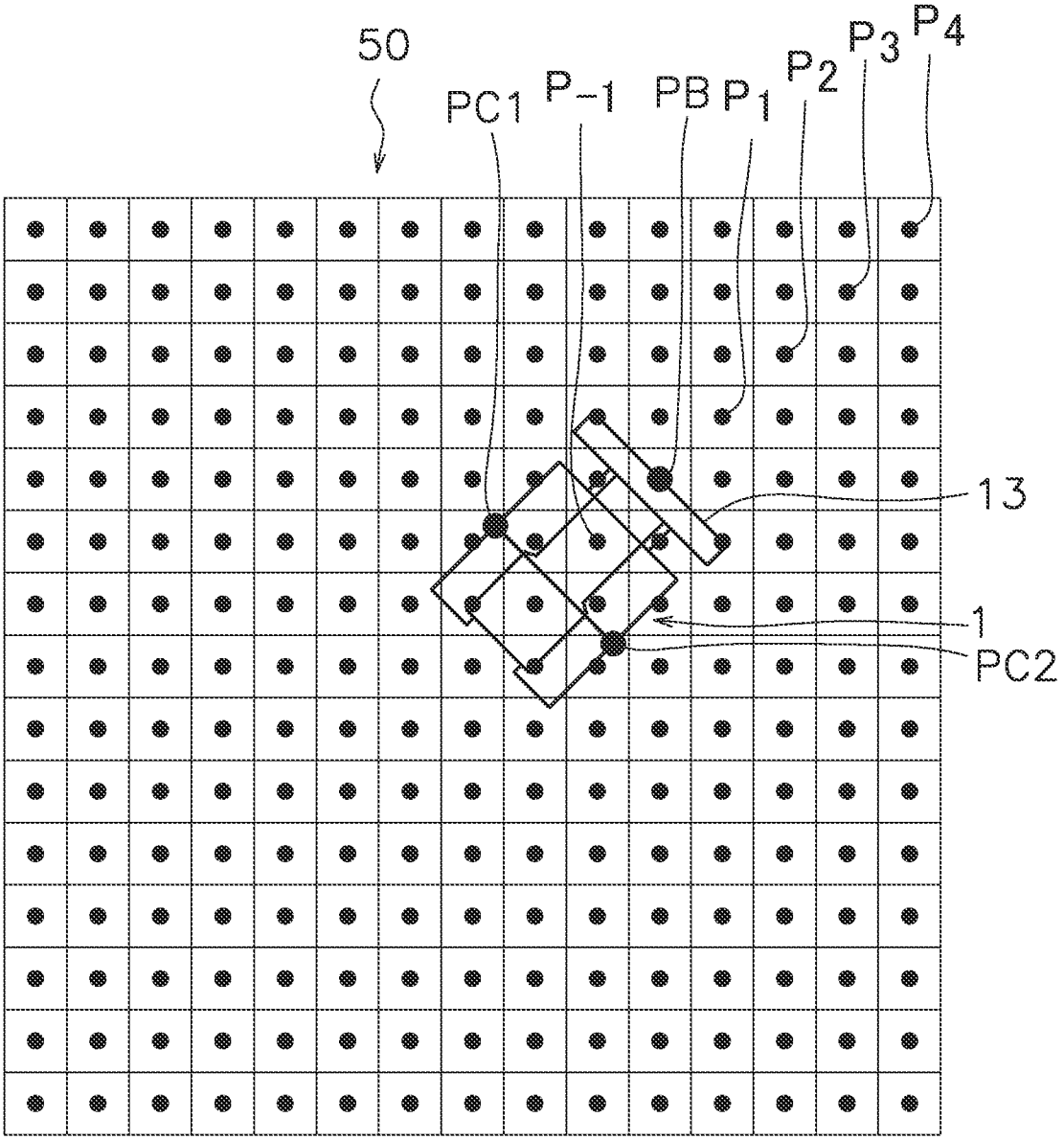
FIG. 5 is a top view showing a current terrain data.

The controller 26 acquires the current terrain data. The current terrain data shows the current terrain of the work site. The current terrain data shows a three-dimensional survey map of the current terrain. FIG. 5 is a top view showing the current terrain 50 around the work machine 1. As illustrated in FIG. 5, the current terrain data indicates the positions of a plurality of points Pn (n is an integer) on the current terrain 50. The plurality of points Pn are representative points in a plurality of areas partitioned by a grid. The current terrain data shows the global coordinates of the plurality of points Pn on the current terrain 50. In FIG. 5, only a part of the plurality of points Pn is marked with a sign, and the signs of the other parts are omitted.

Figure 6:
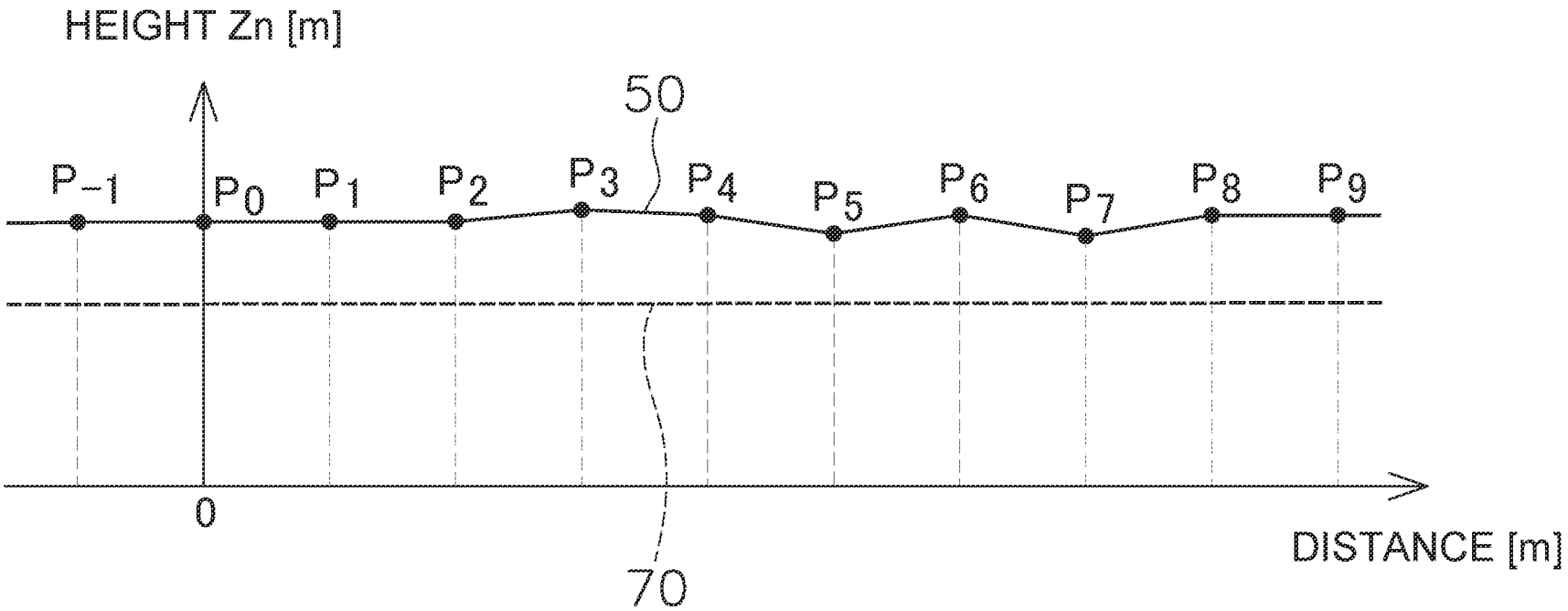
FIG. 6 is a side view showing the current terrain data.

FIG. 6 is a side sectional view of the current terrain 50. In FIG. 6, the vertical axis indicates the height of the terrain. The horizontal axis shows the distance from the current position in the traveling direction of the work machine 1. As illustrated in FIG. 6, the current terrain data shows the height Zn at the plurality of points Pn. The plurality of points Pn are arranged at predetermined intervals. The predetermined interval is, for example, 1 m. However, the predetermined distance may be a distance different from 1 m.

The initial current terrain data is stored in the storage device 28 in advance. For example, initial current terrain data may be acquired by laser surveying. The controller 26 acquires the latest current terrain data and updates the current terrain data while the work machine 1 is moving. Specifically, the controller 26 acquires the heights of the plurality of points Pn on the current terrain 50 through which the crawler tracks 16 have passed.

Specifically, as illustrated in FIGS. 3 and 5, the controller 26 acquires the positions PC1 and PC2 of the bottom of the crawler tracks 16 based on the global coordinates of the vehicle body 11 and the machine data. The position PC1 is a position of the bottom of the left crawler track 16. The position PC2 is a position of the bottom of the crawler track 16 on the right side. The controller acquires the positions PC1 and PC2 at the bottom of the crawler tracks 16 as the heights of the plurality of points Pn on the current terrain 50 through which the crawler tracks 16 have passed.

Next, an automatic control of the work machine 1 executed by the controller 26 will be described. The automatic control of the work machine 1 may be a semi-automatic control performed in combination with a manual operation by the operator. For example, the forward and backward movements of the work machine 1 may be operated by the operator, and the operation of the work implement 13 may be automatically controlled by the controller 26. Alternatively, the automatic control of the work machine 1 may be a fully automatic control performed without manual operation by the operator.

Figure 7:
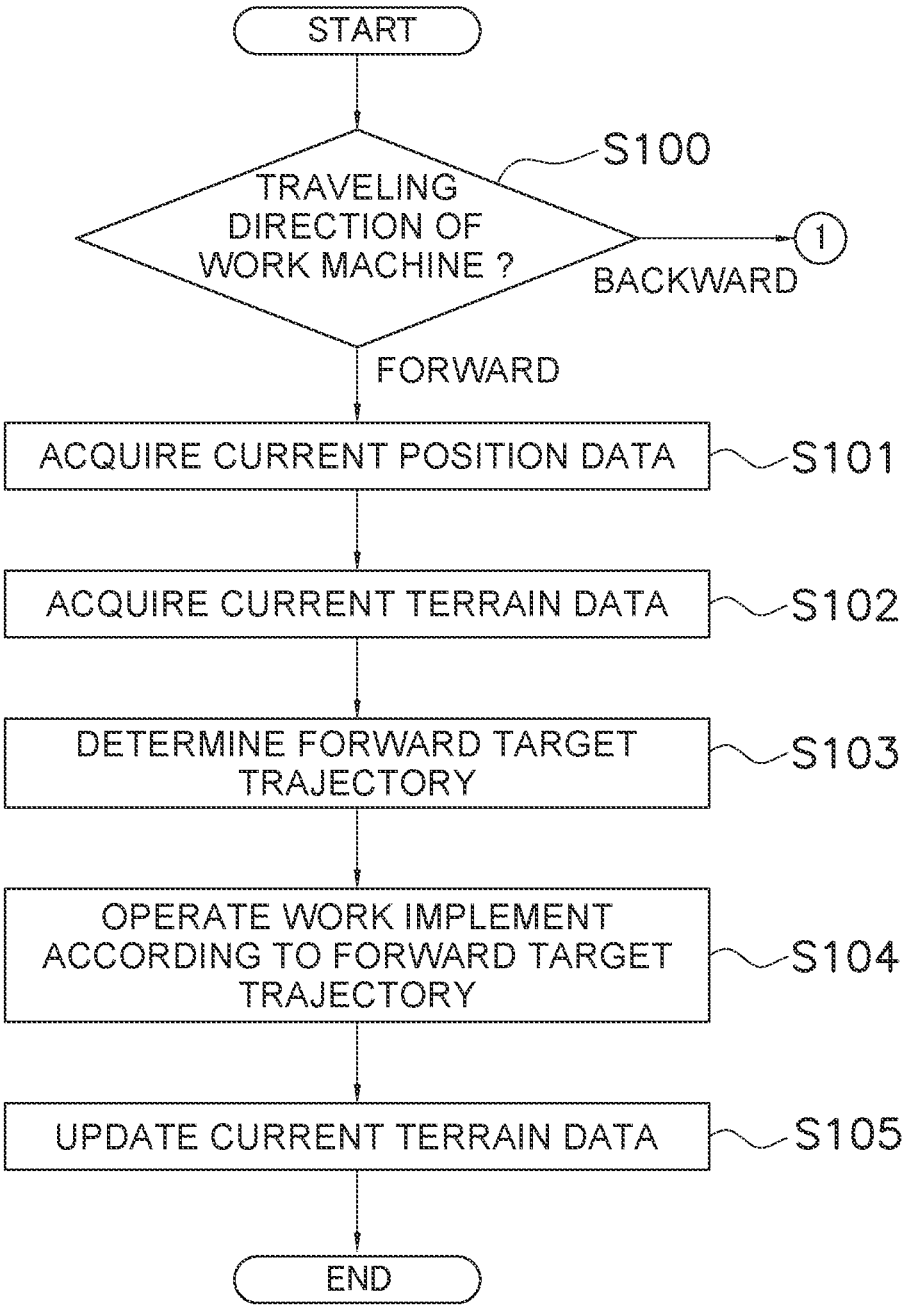
FIG. 7 is a flowchart showing a process of a forward control of the work machine.

FIG. 7 is a flowchart showing the automatic control process of the work machine 1. As illustrated in FIG. 7, in step S100, the controller 26 determines the traveling direction of the work machine 1. Here, the controller 26 determines whether the work machine 1 is moving forward or backward based on the signal from the input device 25. When the work machine 1 is moving forward, the controller 26 executes the forward control process illustrated in step S101 and subsequent steps. In step S101, the controller 26 acquires the cutting edge position data. Here, the controller 26 acquires the current cutting edge position PB of the blade 18 as described above.

In step S102, the controller 26 acquires the current terrain data. For example, the controller 26 reads the current terrain data within a predetermined range in front of the work machine 1 from the storage device 28.

In step S103, the controller 26 determines the target trajectory 70 (hereinafter, referred to as "forward target trajectory 70") for the forward movement of the work machine 1. As illustrated in FIG. 6, at least a part of the forward target trajectory 70 is located below the current terrain 50. The forward target trajectory 70 indicates the target trajectory of the cutting edge of the blade 18 in the work. In FIG. 6, the entire forward target trajectory 70 is located below the current terrain 50. However, a part of the forward target trajectory 70 may be located at the same height as the current terrain 50 or above the current terrain 50.

For example, the controller 26 determines a plane located below the current terrain 50 by a predetermined distance as the forward target trajectory 70. However, the method for determining the forward target trajectory 70 is not limited to this, and may be changed. For example, the controller 26 may determine the terrain in which the current terrain 50 is displaced downward by a predetermined distance as the forward target trajectory 70. The forward target trajectory 70 may be horizontal. The forward target trajectory 70 may be inclined with respect to the horizontal in the traveling direction of the work machine 1. The forward target trajectory 70 may be inclined with respect to the horizontal in the vehicle width direction of the work machine 1.

In step S104, the controller 26 operates the work implement 13 according to the forward target trajectory 70. The controller 26 generates a command signal to the work implement 13 so that the cutting edge position PB of the blade 18 moves according to the forward target trajectory 70. The controller 26 outputs the command signal to the control valve 27. As a result, work implement 13 operates according to the forward target trajectory 70. The work machine 1 operates the work implement 13 according to the forward target trajectory 70 while moving forward. As a result, the current terrain 50 is excavated by the work implement 13.

In step S105, the controller 26 updates the current terrain data. As described above, the controller 26 acquires the heights of the plurality of points Pn on the current terrain 50 through which the crawler tracks 16 have passed while the work machine 1 is moving forward. The controller 26 updates the current terrain data with the heights of the plurality of points Pn acquired during the forward movement.

When the work machine 1 reaches a predetermined reversal position, the work machine 1 is switched from forward to backward. In this case, in step S100 described above, the controller 26 determines that the work machine 1 is moving backward. While the work machine 1 is moving backward, the controller 26 executes the backward control process illustrated in step S201 and subsequent steps illustrated in FIG. 8.

Figure 8:
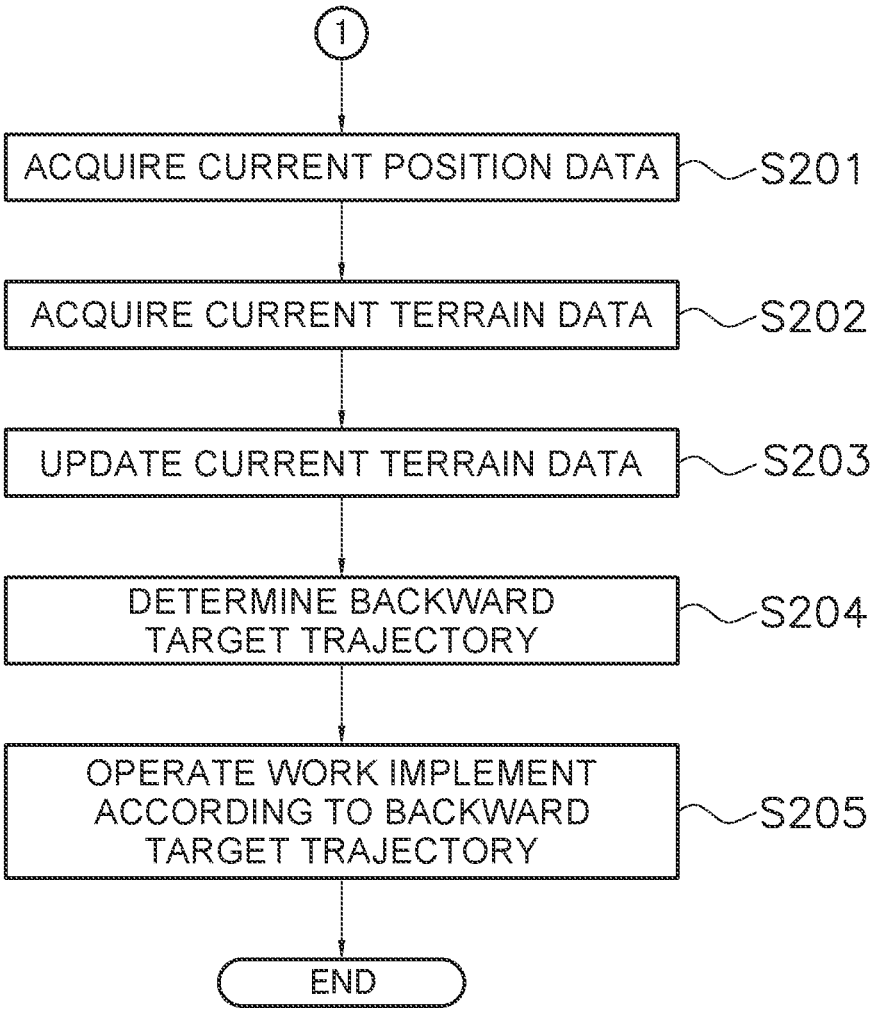
FIG. 8 is a flowchart showing a process of a backward control of the work machine.

As illustrated in FIG. 8, in step S201, the controller 26 acquires the cutting edge position data. Here, the controller 26 acquires the current cutting edge position PB of the blade 18 as described above.

In step S202, the controller 26 acquires the current terrain data. For example, the controller 26 reads the current terrain data within a predetermined range behind the work machine 1 from the storage device 28.

In step S203, the controller 26 updates the current terrain data. The controller 26 acquires the heights of the plurality of points Pn on the current terrain 50 through which the crawler tracks 16 have passed while the work machine 1 is moving backward. The controller 26 updates the current terrain data according to the heights of the plurality of points Pn acquired during the backward movement.

In step S204, the controller 26 determines the target trajectory 80 (hereinafter, referred to as "backward target trajectory 80") for the backward movement of the work machine 1. The controller 26 determines the backward target trajectory 80 based on the heights of the plurality of points Pn on the updated current terrain 50. Specifically, the controller 26 acquires the cutting edge position PB of the work implement 13. As illustrated in FIG. 5, the cutting edge position PB is a midpoint position of the cutting edge of the blade 18 in the vehicle width direction. The controller 26 determines the backward target trajectory 80 based on the heights of the plurality of points Pn around the cutting edge position PB.

Figure 9:
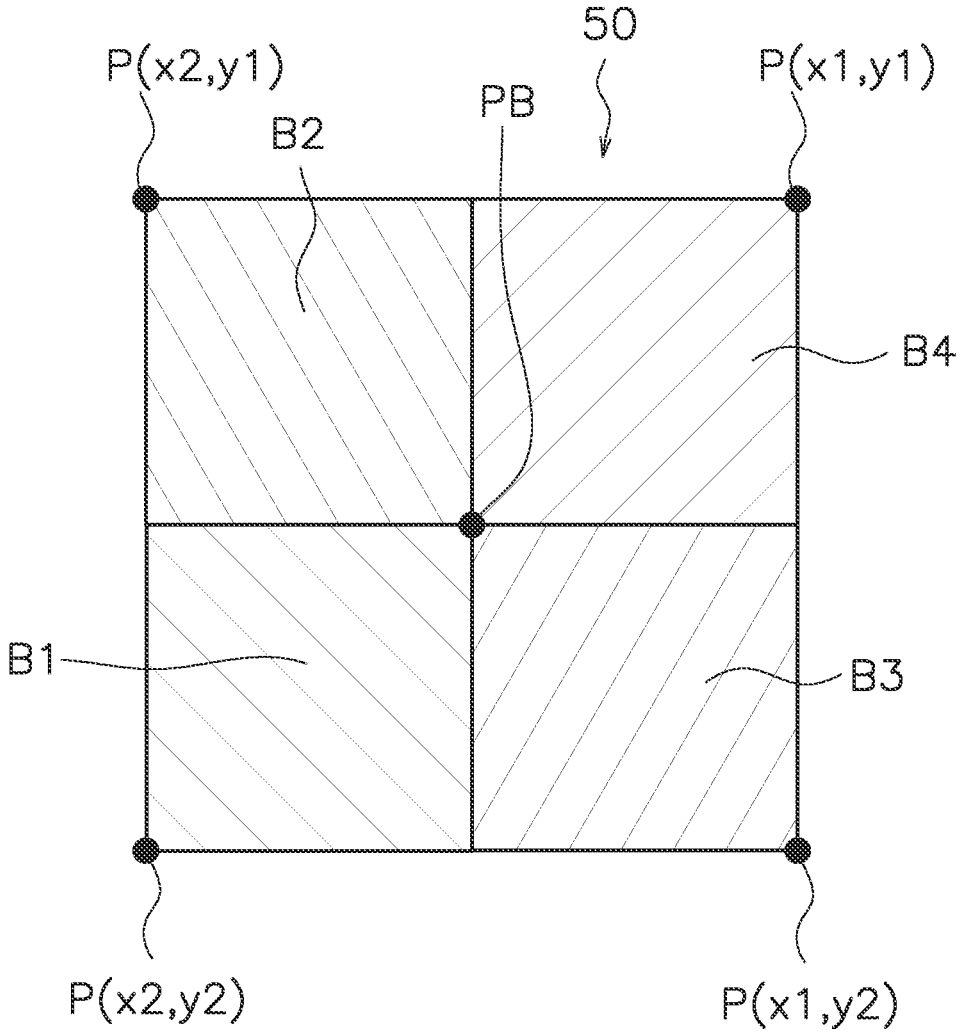
FIG. 9 is a diagram showing a method for determining a target height at a cutting edge position.

For example, as illustrated in FIG. 9, the controller 26 acquire the heights of the four points P(x1, y1), P(x2, y1), P(x1, y2), and P(x2, x2) located on the front, back, left, and right of the cutting edge position PB. The controller 26 calculates the target height at the cutting edge position PB from the heights of the four points P(x1, y1), P(x2, y1), P(x1, y2), and P(x2, y2). The controller 26 uses, for example, bilinear complementation to calculate the target height at the cutting edge position PB from the heights of the four points P(x1, y1), P(x2, y1), P(x1, y2), and P(x2, y2).

The controller 26 calculates the target height at the cutting edge position PB by the following equation (1).

$$ZB=\{A1*Z(x1,y1)+A2*Z(x1,y2)+A3*Z(x2,y1)+A4*Z(x2,y2)\}/(A1+A2+A3+A4) \quad (1)$$

ZB is the target height at the cutting edge position PB. Z(x1, y1), Z(x2, y1), Z(x1, y2), and Z(x2, y2) are the heights of the plurality of points P(x1, y1), P(x2, y1), P(x1, y2), and P(x2, y2) around the cutting edge position PB, respectively. A1 is the area of region B1. A2 is the area of region B2. A3 is the area of region B3. A4 is the area of region B4.

The controller 26 calculates the target height ZB at the cutting edge position PB and updates the target height ZB. While the work machine 1 is moving backward, the controller 26 repeatedly executes the calculation of the target height ZB and continues to move backward. The controller 26 determines the backward target trajectory 80 so that the cutting edge position PB is located at the target height ZB.

The controller 26 determines the backward target trajectory 80 so as to be parallel to the forward target trajectory 70 in the vehicle width direction of the work machine 1. Alternatively, the controller 26 may determine the backward target trajectory 80 so as to be horizontal in the vehicle width direction of the work machine 1. Alternatively, the controller 26 may determine the backward target trajectory 80 so as to incline at a predetermined angle with respect to the horizontal in the vehicle width direction of the work machine 1.

In step S204, the controller 26 operates the work implement 13 according to the backward target trajectory 80. The controller 26 generates a command signal to the work implement 13 so that the cutting edge position PB of the blade 18 moves according to the backward target trajectory 80. The controller 26 outputs a command signal to the control valve 27. As a result, the work implement 13 operates according to the backward target trajectory 80. The work machine 1 operates the work implement 13 according to the backward target trajectory 80 while moving backward.

Figure 10A:
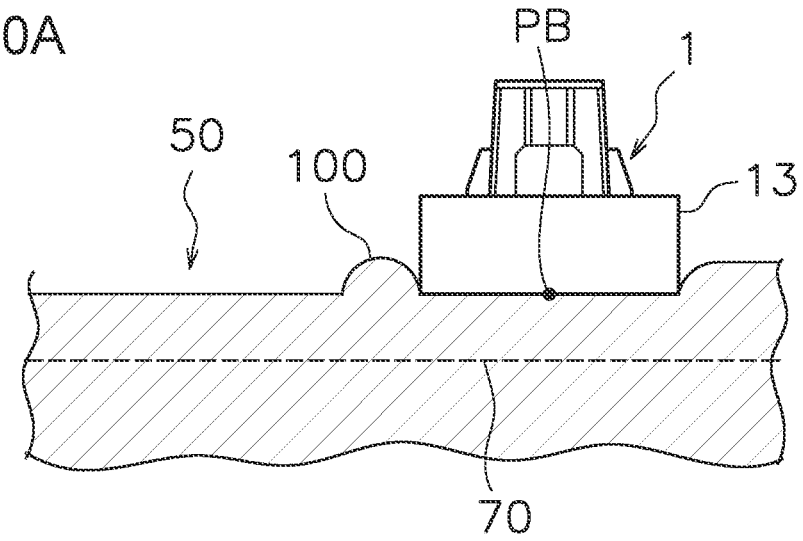
FIG. 10A, FIG. 10B and FIG. 10C are diagrams showing an example of an operation when the work machine is moving backward.
Figure 10B:
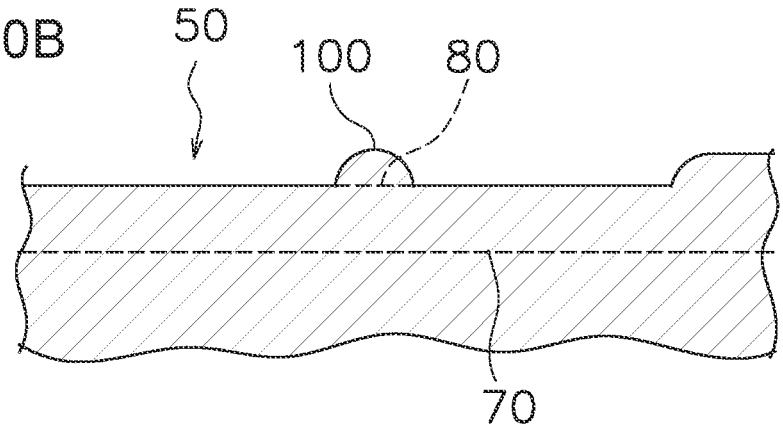
Figure 10C:
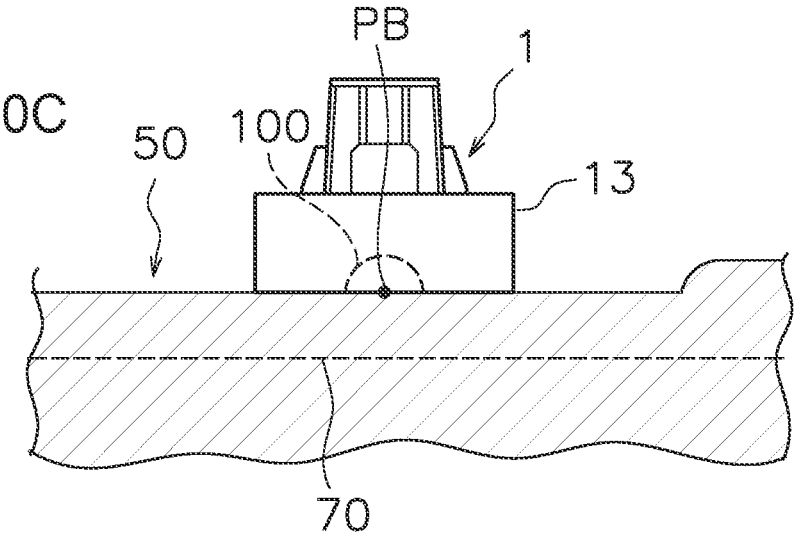

For example, as illustrated in FIG. 10A, soil 100 (hereinafter referred to as "windrow 100") spilled from the blade 18 when the work machine 1 moves forward and excavates may remain on the current terrain 50 . . . . In the control system 3 according to the present embodiment, when the work machine 1 moves backward to the next excavation start position, the controller 26 determines the backward target trajectory 80 as illustrated in FIG. 10B. Then, as illustrated in FIG. 10C, the windrow 100 can be removed by the work implement 13 operating according to the backward target trajectory 80.

In the control system 3 of the work machine 1 according to the present embodiment described above, the work implement 13 operates according to the backward target trajectory 80 not only when the work machine 1 moves forward but also when the work machine 1 moves backward. Thereby, the efficiency of the work by the work machine 1 can be improved.

Although one embodiment has been described above, the present invention is not limited to the above embodiment, and various modifications can be made without departing from the gist of the invention.

The work machine 1 is not limited to a bulldozer, and may be another vehicle such as a wheel loader, a motor grader, or a hydraulic excavator. The work machine 1 may be a vehicle driven by an electric motor. In that case, the engine 22 and the engine compartment 15 may be omitted.

The controller 26 may have a plurality of controllers that are provided separately from each other. The above-mentioned processing may be distributed to a plurality of controllers and executed.

Figure 11:
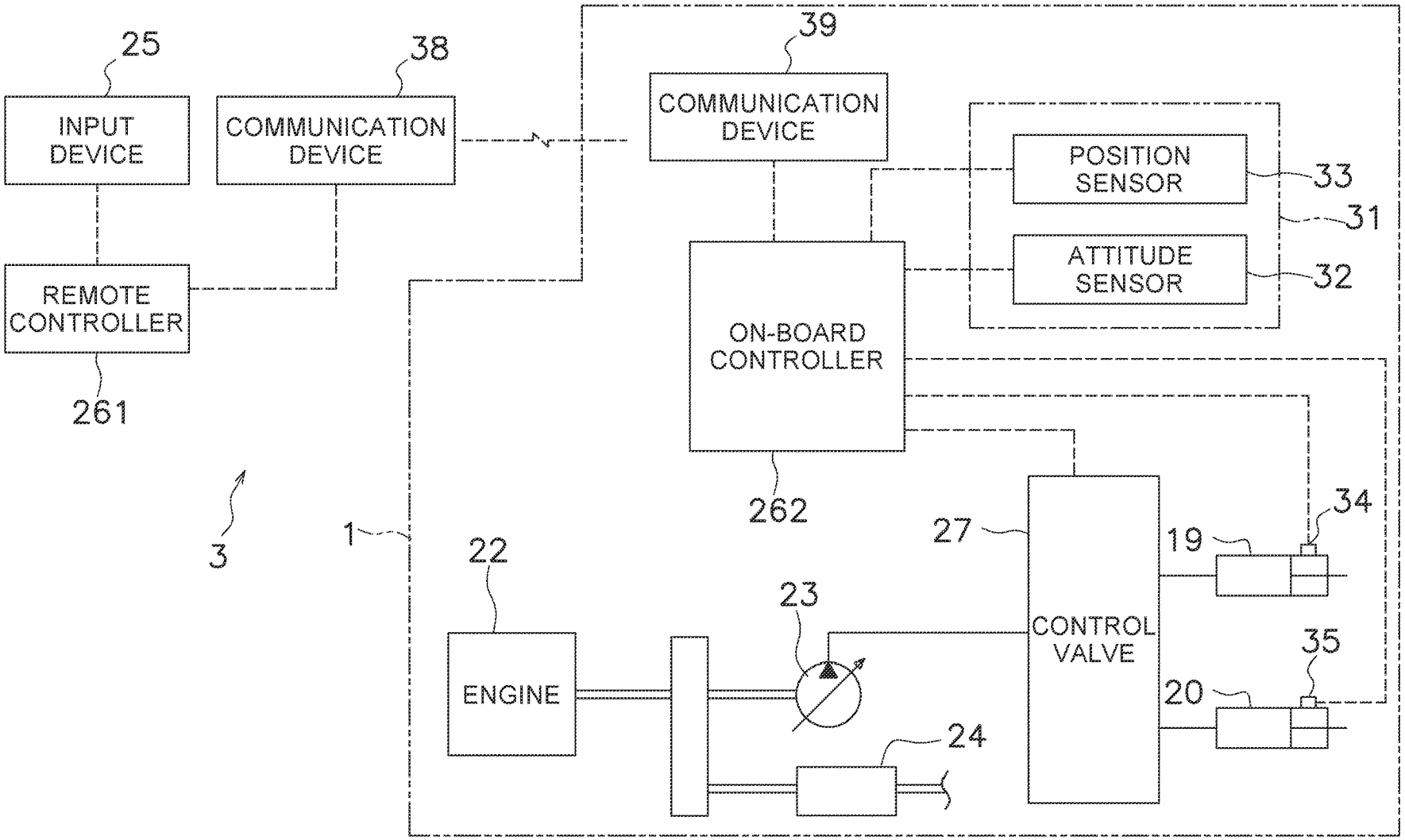
FIG. 11 is a block diagram showing a first modification of the structure of the control system.

The work machine 1 may be a vehicle that can be remotely controlled. In that case, a part of the control system 3 may be arranged outside the work machine 1. For example, as illustrated in FIG. 11, the controller 26 may include a remote controller 261 and an on-board controller 262. The remote controller 261 may be arranged outside the work machine 1. For example, the remote controller 261 may be located in an external management center of the work machine 1. The on-board controller 262 may be mounted on the work machine 1.

The remote controller 261 and the on-board controller 262 may be configured to communicate wirelessly via the communication devices 38 and 39. Then, a part of the functions of the controller 26 described above may be executed by the remote controller 261 and the remaining functions may be executed by the on-board controller 262. For example, the process of determining the forward target trajectory 70 and the backward target trajectory 80 may be executed by the remote controller 261. The process of outputting the command signal to the work implement 13 may be executed by the on-board controller 262.

The input device 25 may be arranged outside the work machine 1. The input device 25 may be omitted from the work machine 1. In that case, the cab may be omitted from the work machine 1.

The current terrain 50 may be acquired by another device not limited to the position sensor 33 described above. For example, the work machine 1 may include a measuring device such as a Lidar (Light Detection and Ranging) device. The controller 26 may acquire the current terrain data based on the current terrain 50 measured by the measuring device.

Figure 12:
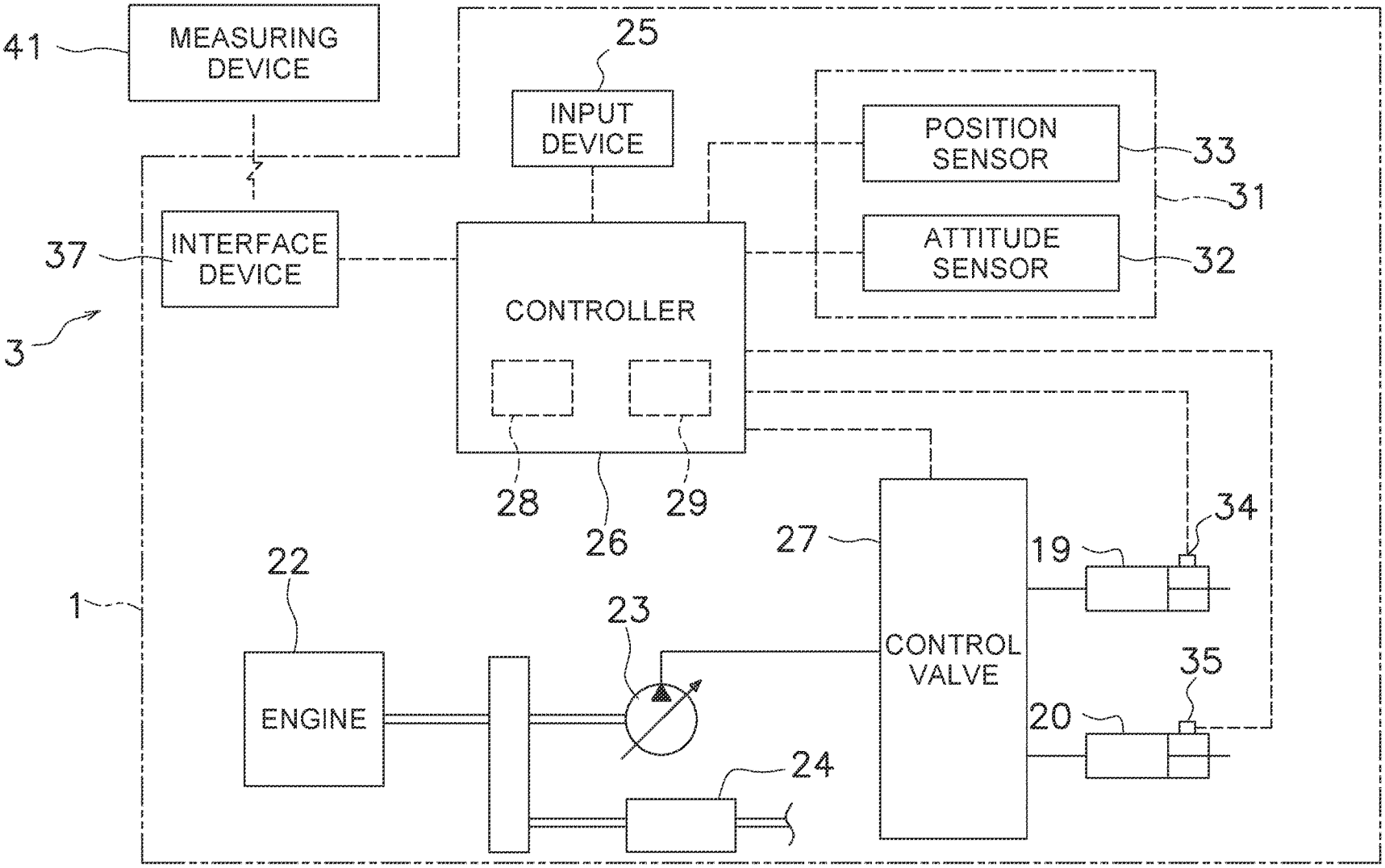
FIG. 12 is a block diagram showing a second modification of the structure of the control system.

As illustrated in FIG. 12, the current terrain 50 may be acquired by the interface device 37 that receives data from an external device. The interface device 37 may wirelessly receive the current terrain data measured by the external measuring device 41. Alternatively, the interface device 37 may be a reading device for a recording medium. The controller 26 may accept the current terrain data measured by the external measuring device 41 via the recording medium.

Figure 13A:
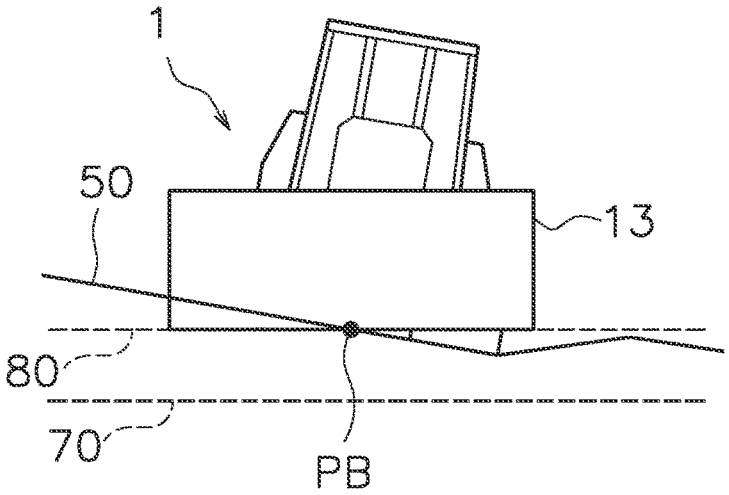
FIG. 13A, FIG. 13B and FIG. 13C are diagrams showing a first modification of the control of the work machine.
Figure 13B:
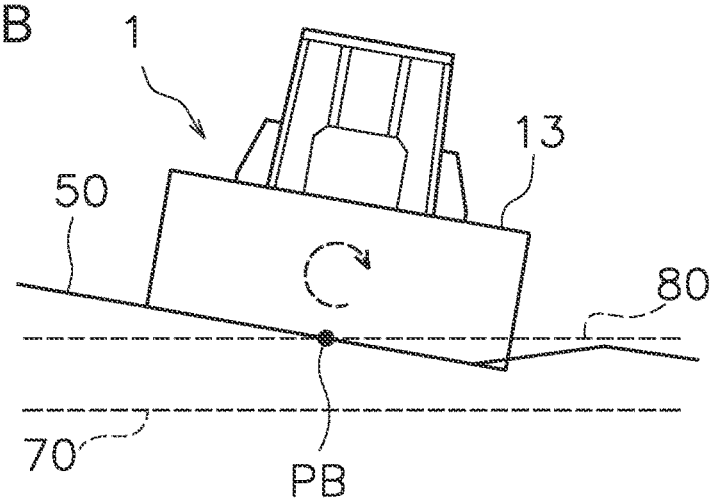
Figure 13C:
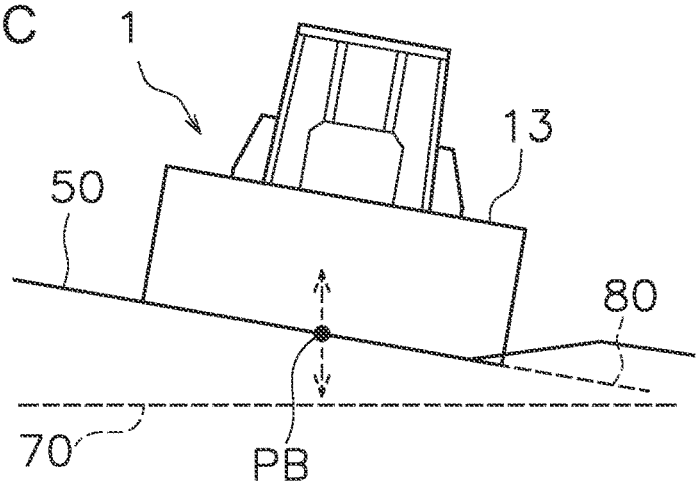

In the above embodiment, the controller 26 determines the backward target trajectory 80 so as to be parallel to the forward target trajectory 70 in the vehicle width direction. However, the controller 26 may change the tilt angle of the work implement 13 according to the manual operation of the input device 25. For example, as illustrated in FIG. 13A, the current terrain 50 may be inclined in the vehicle width direction with respect to the forward target trajectory 70. In this case, the operator may operate the input device 25 to manually change the tilt angle of the work implement 13 so that the cutting edge of the blade 18 is parallel to the current terrain 50. As a result, as illustrated in FIG. 13B, the controller 26 may change the tilt angle of the work implement 13 according to the manual operation. After that, as illustrated in FIG. 13C, while the work machine 1 is moving backward, the controller 26 may move the work implement 13 up and down according to the backward target trajectory 80 while holding the work implement 13 at the changed tilt angle.

The method for determining the backward target trajectory 80 is not limited to that of the above embodiment, and may be changed. For example, the controller 26 may displace the target height ZB of the above embodiment by a predetermined distance in the vertical direction.

Figure 14:
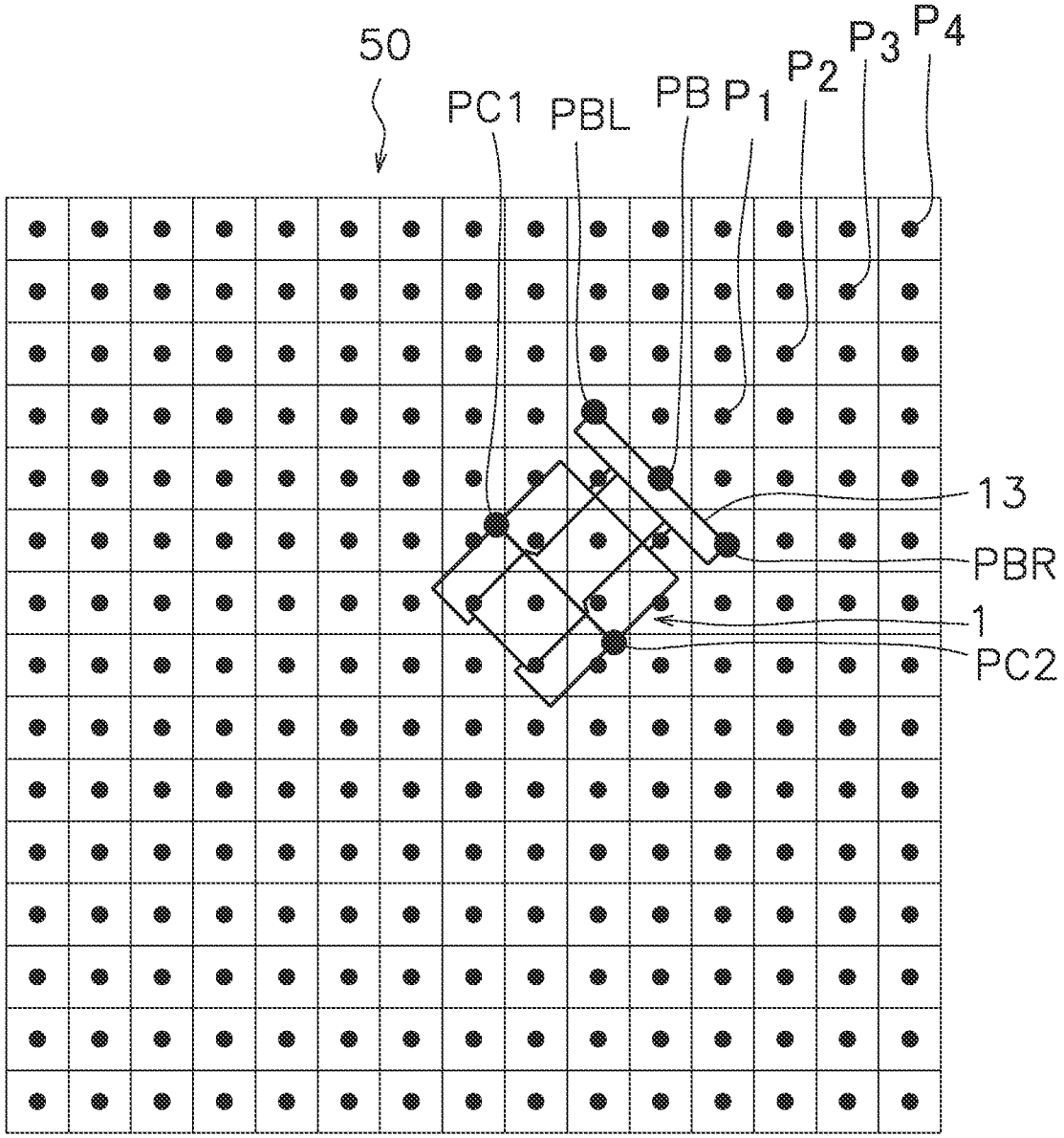
FIG. 14 is a diagram showing a second modification of the control of the work machine.

The controller 26 may determine the target height ZB at least two positions apart from each other in the vehicle width direction on the cutting edge of the blade 18. For example, as illustrated in FIG. 14, the controller 26 may determine a target height ZBL of the left end position PBL of the cutting edge (hereinafter, referred to as "left target height ZBL") and a target height ZBR of the right end position PBR (hereinafter, referred to as "right target height ZBR").

The controller 26 may acquire the heights of a plurality of points around the left end position PBL of the cutting edge. The controller 26 may calculate the left target height ZBL from the heights of the plurality of points in the same manner as in the method for determining the target height ZB of the above embodiment. The controller 26 may acquire the heights of a plurality of points around the right end position PBR of the cutting edge. The controller 26 may calculate the right target height ZBR from the heights of the plurality of points in the same manner as in the method for determining the target height ZB of the above embodiment.

Figure 15:
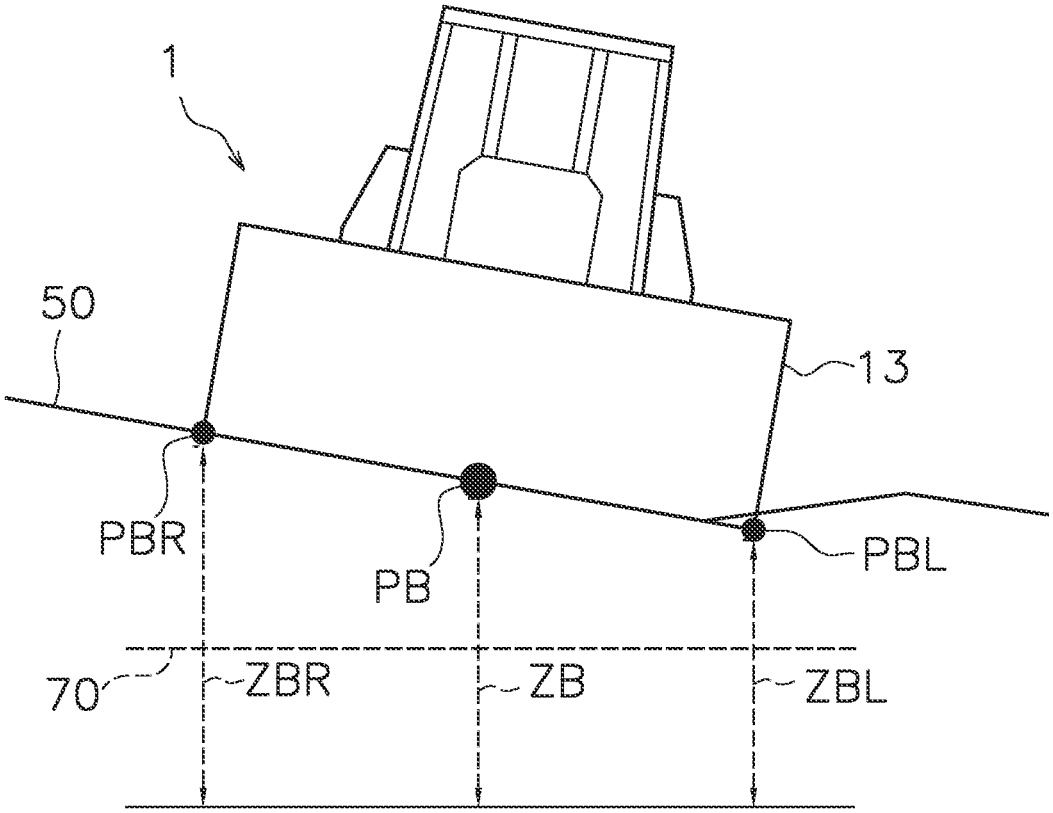
FIG. 15 is a diagram showing the second modification of the control of the work machine.

As illustrated in FIG. 15, the controller 26 may calculate the target height ZB at the cutting edge position PB from the left target height ZBL and the right target height ZBR. The controller 26 may determine the average value of the left target height ZBL and the right target height ZBR as the target height ZB at the cutting edge position PB.

Further, the controller 26 may determine the target tilt angle from the left target height ZBL and the right target height ZBR. The controller 26 may calculate the target tilt angle from the difference between the left target height ZBL and the right target height ZBR. The controller 26 may automatically control the work implement 13 so that the tilt angle of the blade 18 becomes the target tilt angle.

Figure 16A:
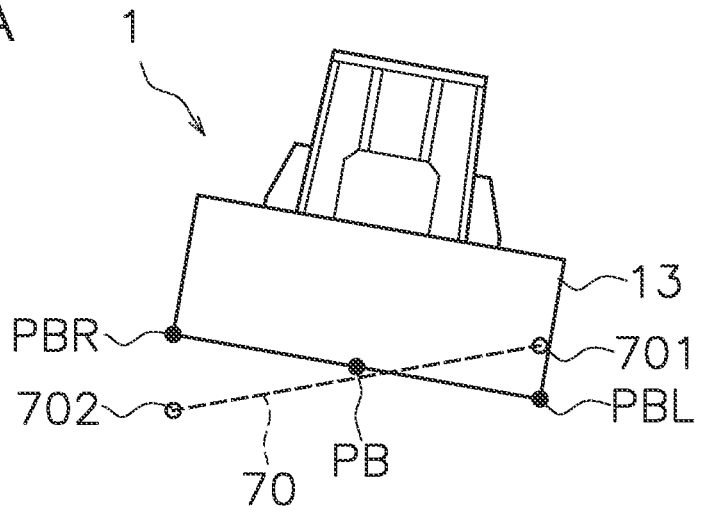
FIG. 16A and FIG. 16B are diagrams showing a third modification of the control of the work machine.

The controller 26 may correct the backward target trajectory 80 so that the cutting edge of the blade 18 does not exceed the forward target trajectory 70 downward. For example, as illustrated in FIG. 16A, the left end position PBL of the cutting edge may be located below the forward target trajectory 70. The right end position PBR of the cutting edge is located above the forward target trajectory 70.

Figure 16B:
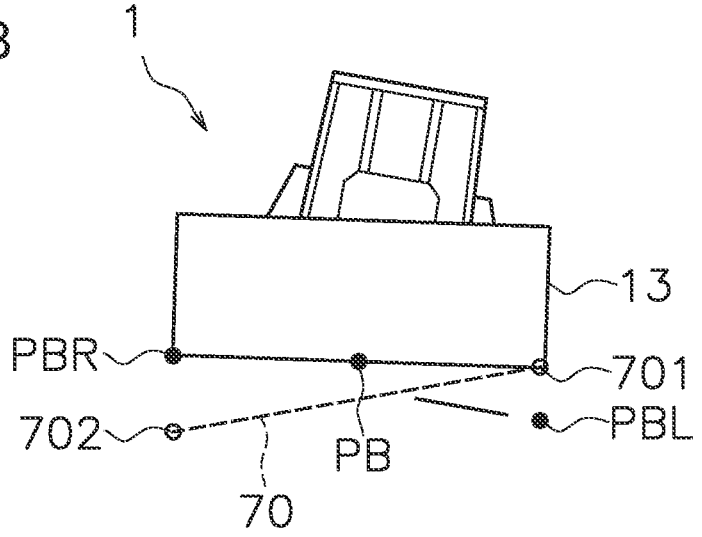

In this case, as illustrated in FIG. 16B, the controller 26 may determine the target tilt angle from the right end position PBR of the cutting edge and the left end position 701 of the forward target trajectory 70. The left end position 701 of the forward target trajectory 70 is a position on the forward target trajectory 70 corresponding to the left end position PBL of the cutting edge.

Alternatively, although not illustrated, the right end position PBR of the cutting edge may be located below the forward target trajectory 70, and the left end position PBL of the cutting edge may be located above the forward target trajectory 70. In that case, the controller 26 may determine the target tilt angle from the left end position PBL of the cutting edge and the right end position 702 of the forward target trajectory 70. The right end position 702 of the forward target trajectory 70 is a position on the forward target trajectory 70 corresponding to the right end position PBR of the cutting edge.

Figure 17A:
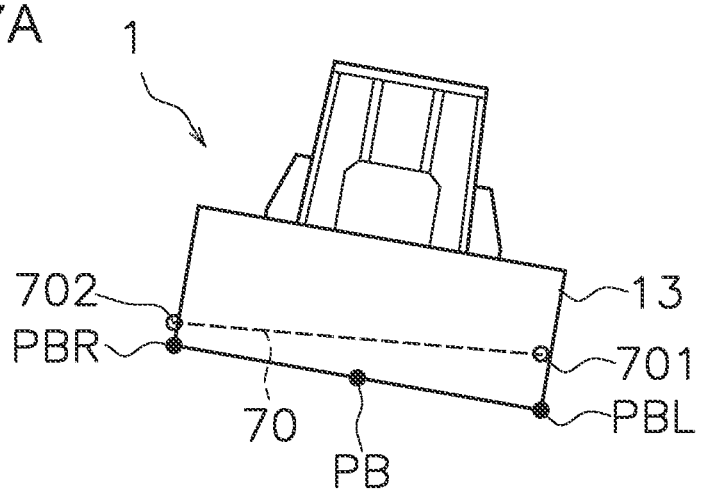
FIG. 17A and FIG. 17B are diagrams showing a fourth modification of the control of the work machine.
Figure 17B:
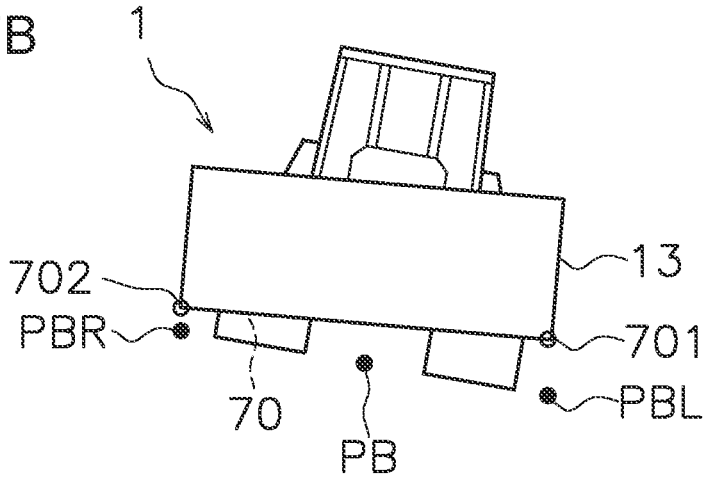

As illustrated in FIG. 17A, both the left end position PBL and the right end position PBR of the cutting edge may be located below the forward target trajectory 70. In this case, as illustrated in FIG. 17B, the controller 26 may determine the target tilt angle from the left end position 701 of the forward target trajectory 70 and the right end position 702 of the forward target trajectory 70.

In the above embodiment, the controller 26 determines the backward target trajectory 80 from the heights of four points around the cutting edge position PB. However, the number of points for determining the backward target trajectory 80 may be less than four or more than four.

Alternatively, the controller 26 may determine the backward target trajectory 80 based on the forward target trajectory 70. For example, the controller 26 may determine the backward target trajectory 80 at the same height as the forward target trajectory 70. Alternatively, the controller 26 may determine the trajectory in which the forward target trajectory 70 is displaced up and down as the backward target trajectory 80.

The forward control is not limited to that of the above embodiment and may be changed. Alternatively, forward control may be omitted. For example, the operator may manually operate the work machine 1 when moving forward. In that case, the controller 26 may acquire the current terrain 50 while moving forward, as in the above embodiment. The controller 26 may perform backward movement control based on the current terrain acquired during forward movement.

INDUSTRIAL APPLICABILITY

According to the present disclosure, it is possible to improve an efficiency of work by a work machine.

The invention claimed is:

1. A control system for a work machine including a work implement, the control system comprising:

a controller configured to acquire current terrain data indicative of a current terrain, determine a target trajectory for a backward movement based on the current terrain, and operate the work implement according to the target trajectory for the backward movement while the work machine is moving backward.

2. The control system according to claim 1, wherein the controller is further configured to determine whether the work machine is switched to backward, and execute a backward control to operate the work implement according to the target trajectory for the backward movement when the work machine is switched to backward.

3. The control system according to claim 1, wherein the controller is further configured to execute a forward control to operate the work implement according to a target trajectory for a forward movement while the work machine is moving forward.

4. The control system according to claim 1, wherein the controller is further configured to
update the current terrain data while the work machine is moving backward, and
determine the target trajectory for the backward movement based on the updated current terrain.

5. The control system according to claim 1, wherein the work machine includes a crawler track, and the controller is further configured to
acquire heights of a plurality of points on the current terrain through which the crawler track pass while the work machine is moving backward, and
determine the target trajectory for the backward movement based on the heights of the plurality of points.

6. The control system according to claim 1, wherein the current terrain data indicates heights of a plurality of points on the current terrain, and the controller is further configured to
acquire a cutting edge position of the work implement, and
determine the target trajectory for the backward movement based on the heights of the plurality of points around the cutting edge position.

7. The control system according to claim 6, wherein the controller is further configured to
acquire a midpoint position of the cutting edge of the work implement in a vehicle width direction,
acquire a target height of the work implement at the midpoint position based on the heights of the plurality of points around the midpoint position, and
determine the target trajectory for the backward movement based on the target height.

8. A control system for a work machine including a work implement, the control system comprising:
a controller configured to operate the work implement according to a target trajectory for a backward movement while the work machine is moving backward; and
an input device manually operable to change a tilt angle of the work implement,
the controller being further configured to
change the tilt angle of the work implement according to a manual operation of the input device, and
while the work implement is moving backward, move the work implement up and down according to the target trajectory for the backward movement while holding the work implement at the tilt angle.

9. The control system according to claim 6, wherein the controller is further configured to
acquire at least two positions separated from each other in the vehicle width direction on the cutting edge of the work implement,
acquire target heights at the at least two points based on the heights of the plurality of points around each of the at least two points, and
determine the target trajectory for the backward movement based on the target heights at the at least two positions.

10. The control system according to claim 9, wherein the controller is further configured to determine a tilt angle of the work implement based on the target heights at the at least two positions.

11. A method performed by a processor for controlling a work machine including a work implement, the method comprising:
acquiring current terrain data indicative of a current terrain;
determining a target trajectory for a backward movement based on the current terrain; and
operating the work implement according to the target trajectory for the backward movement while the work machine is moving backward.

12. The method according to claim 11, further comprising:
determining whether the work machine is switched to backward, and
operating the work implement according to the target trajectory for the backward movement when the work machine is switched to backward.

13. The method according to claim 11, further comprising:
executing a forward control to operate the work implement according to a target trajectory for a forward movement while the work machine is moving forward.

14. The method according to claim 11, further comprising:
updating the current terrain data while the work machine is moving backward,
the determining the target trajectory for the backward movement including determining the target trajectory for the backward movement based on the updated current terrain.

15. The method according to claim 11, wherein
the work machine includes a crawler track,
the method further comprises acquiring heights of a plurality of points on the current terrain through which the crawler track pass while the work machine is moving backward, and
the determining the target trajectory for the backward movement includes determining the target trajectory for the backward movement based on the heights of the plurality of points.

16. The method according to claim 11, wherein
the current terrain data indicates heights of a plurality of points on the current terrain,
the method further comprises acquiring a cutting edge position of the work implement, and
the determining the target trajectory for the backward movement includes determining the target trajectory for the backward movement based on the heights of the plurality of points around the cutting edge position.

17. The method according to claim 11, further comprising:
acquiring a midpoint position of a cutting edge of the work implement in a vehicle width direction, and
acquiring a target height of the work implement at the midpoint position based on heights of a plurality of points around the midpoint position, wherein
the determining the target trajectory for the backward movement including determining the target trajectory for the backward movement based on the target height.

18. A method performed by a processor for controlling a work machine including a work implement, the method comprising:
operating the work implement according to a target trajectory for a backward movement while the work machine is moving backward;
receiving a signal from a manually operable input device to change a tilt angle of the work implement, and
changing the tilt angle of the work implement according to a manual operation of the input device, wherein
the operating the work implement including operating the work implement up and down according to the target trajectory for the backward movement while holding the work implement at the tilt angle when the work implement is moving backward.

* * * * *